United States Patent [19]

Wallace et al.

[11] Patent Number: 4,750,335

[45] Date of Patent: Jun. 14, 1988

[54] ANTI-CONDENSATION MEANS FOR GLASS FRONT DISPLAY CASES

[75] Inventors: George E. Wallace, Levittown, Pa.; Robert M. Foy, Trenton, N.J.

[73] Assignee: Hill Refrigeration Corporation, Trenton, N.J.

[21] Appl. No.: 57,551

[22] Filed: Jun. 3, 1987

[51] Int. Cl.[4] ..... A47F 3/04

[52] U.S. Cl. ..... 62/248; 62/256

[58] Field of Search ..... 62/248, 255, 256, 275

[56] References Cited

U.S. PATENT DOCUMENTS

| | | | |
|---|---|---|---|
| 1,934,864 | 11/1933 | Lambert et al. | 62/248 |
| 3,091,942 | 6/1963 | Dickson et al. | 62/276 X |
| 3,269,787 | 8/1966 | Harter | 62/248 X |
| 3,333,437 | 8/1967 | Brennan | 62/275 X |
| 3,358,467 | 12/1967 | Hickox et al. | 62/256 X |
| 3,465,536 | 9/1969 | Vogel et al. | 62/256 X |
| 4,145,893 | 3/1979 | Vogel | 62/248 X |
| 4,270,819 | 6/1981 | Ooho | 62/255 X |
| 4,478,047 | 10/1984 | Abrahim | 62/256 X |

*Primary Examiner*—William E. Tapolcai
*Attorney, Agent, or Firm*—Sperry, Zoda & Kane

[57] ABSTRACT

A refrigerated food display case of the closed front type is provided with an improved means for inhibiting the formation of condensation on the front display window. To this end, the display case includes means dividing chilled air circulated within the case, into primary and secondary air curtains flowing across the display window. A heating means mounted only within the secondary air passage operates throughout each refrigeration cycle, to heat only the chilled air flowing within the secondary passage, thereby forming it into a secondary air curtain interposed between the window and the primary, fully chilled flow of air that has passed through the primary air passage and hence has not been exposed to the heating means. The warm air curtain, impinging upon the surface of the window, inhibits the formation of condensate thereon, such as commonly occurs due to the disparity of ambient temperature and the lower, interior case temperature.

8 Claims, 2 Drawing Sheets

ANTI-CONDENSATION MEANS FOR GLASS FRONT DISPLAY CASES

BACKGROUND OF THE INVENTION

1. Field of the Invention

The present invention relates generally to commercial, refrigerated food display cases of the type commonly found in supermarkets and similar establishments. In a more particular sense, the invention has application to cases of the type described, in which the front of the case is closed by a display window and access to the case is normally had through rear doors. Cases of this type are in widespread use, for marketing service meats, cheeses, or other products that must be sliced or otherwise prepared according to the wishes of the customer, or for marketing other products such as fresh fish or delicatessen items.

In a still more particular sense, the field of the invention may be described as that in which are included devices for preventing the condensation of moisture on the display windows or other transparent surfaces, in food display cases coming within the above stated categories.

2. Description of the Prior Art

The problem of inhibiting, or hopefully completely preventing, the formation of condensate on the surfaces of the display windows of food display cases, has probably existed since cases of this type were first designed. Given a predetermined low temperature and humidity within the case in relation to that in the surrounding ambient, condensation will occur despite various design features and expedients employed to overcome the problem.

It has been proposed, for example, to provide multi-panel display windows, and these have had good results. They have the problem, however, of being very expensive. Further, the display windows of modern cases are almost always hinged so that they may be swung upwardly to facilitate loading or cleaning of the case, or cleaning of the interior surface of the window. Multi-pane windows have not heretofore been liftable because of their great weight, and also because lifting imposes torque on the window, which in turn may break the seal between the panes. This may cause leakage, requiring replacement of the entire window.

Single-pane glass can, of course, be made in any of various attractive, curvilinear forms. Single-pane display windows have, however, the disadvantage that they are particularly subject to condensation problems.

It has been heretofore proposed, to eliminate or inhibit the formation of condensate on the surfaces of display windows of refrigerated display cases, that the interior surface of the window be heated. It has been proposed, for example, to force hot air through spaces occurring between the panes of a flat, multi-pane, display window as disclosed, for example, in Green U.S. Pat. No. 2,257,948. It has also been proposed to circulate hot gas through conduits to heat air in a manner that will cause the heated air to rise immediately adjacent the undersurface of the display window (Jarvis U.S. Pat. No. 2,287,997). Or, as disclosed in U.S. Pat. No. 2,706,387 issued to Swanson, exterior surfaces of display windows have been heated by air passing through a two-part condenser. And, in U.S. Pat. No. 4,325,227 issued to Ibrahim, ambient air is drawn from the exterior of the cabinet through a space between the panes of a multi-pane window. In Ibrahim U.S. Pat. No. 4,361,012 it is again proposed that an ambient air band be passed across the outer surface of the display window, to warm the glass panes slightly so that condensate on the interior glass pane surfaces can be reduced. All of these attacks on the condensation problem share a common deficiency, in that they represent relatively complicated approaches which in some instances are not practical from a manufacturing standpoint, in other instances are not cost-effective, and in still other instances fail to assure minimal formation of condensate on the interior surface of the display window, especially if the window be of the single-pane type.

Further, in the prior art, there has been no suggestion for utilizing a curvilinear window form whereby a heated air flow will travel smoothly, that is, with minimum turbulent effect, along several angularly related interior surfaces of the window, which surfaces are connected by smoothly curved areas, in such a way as to maximize the efficiency of the anti-condensate warm air flow and at the same time provide a window that permits viewing of the product from directly above as well as from the front of the case.

SUMMARY OF THE INVENTION

To overcome the above-noted deficiencies of the prior art, the present invention, summarized briefly, comprises, in a preferred embodiment, a single-pane window of curvilinear form, which at its lower end includes a viewing surface that is almost vertical, and which at its upper end includes a viewing surface which is horizontal and which defines part of the top of the case. In association with a window of this type, there is provided a display case having rear access doors separated by hollow mullions, formed to define air conduits. Within the case, air is circulated in a closed path, in a refrigerated condition, under the food display support pan, and then upwardly and over the food, returning to a plenum beneath the pan for re-chilling and recirculation.

The circulated air, passing upwardly along the interior surface of the display window, is in accordance with the invention divided into a primary and a secondary air panel. The secondary air panel, within the duct in which the refrigerated air is divided into said panels, is subjected to heat emanating from an electric heating element disposed in the secondary air passage. The electric heating element is preferably in an energized condition throughout each refrigerating cycle. As a result, although air entering both the primary and secondary air passages is at a single, low temperature, the air emanating from said passages in the form of the primary and secondary panels is at different temperatures, with the secondary air panel being at a temperature elevated sufficiently to prevent the fully refrigerated primary air panel from impinging against the inner surface of the display window. Interposition of the secondary air panel or curtain between the primary panel and the window thus inhibits the formation of condensate.

The secondary air panel, when directed against the inner surface of the display window, flows upwardly along said inner surface, past the various curved areas, without any turbulent effect due to the provision of gradual curves in the curvilinear glass form, until eventually, at the top of the case, it passes into a return inlet, is mixed with the return air from the primary air curtain, and flows downwardly through the mullions for re-chilling and recirculation.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

BRIEF DESCRIPTION OF THE PREFERRED EMBODIMENT

Figure 1:
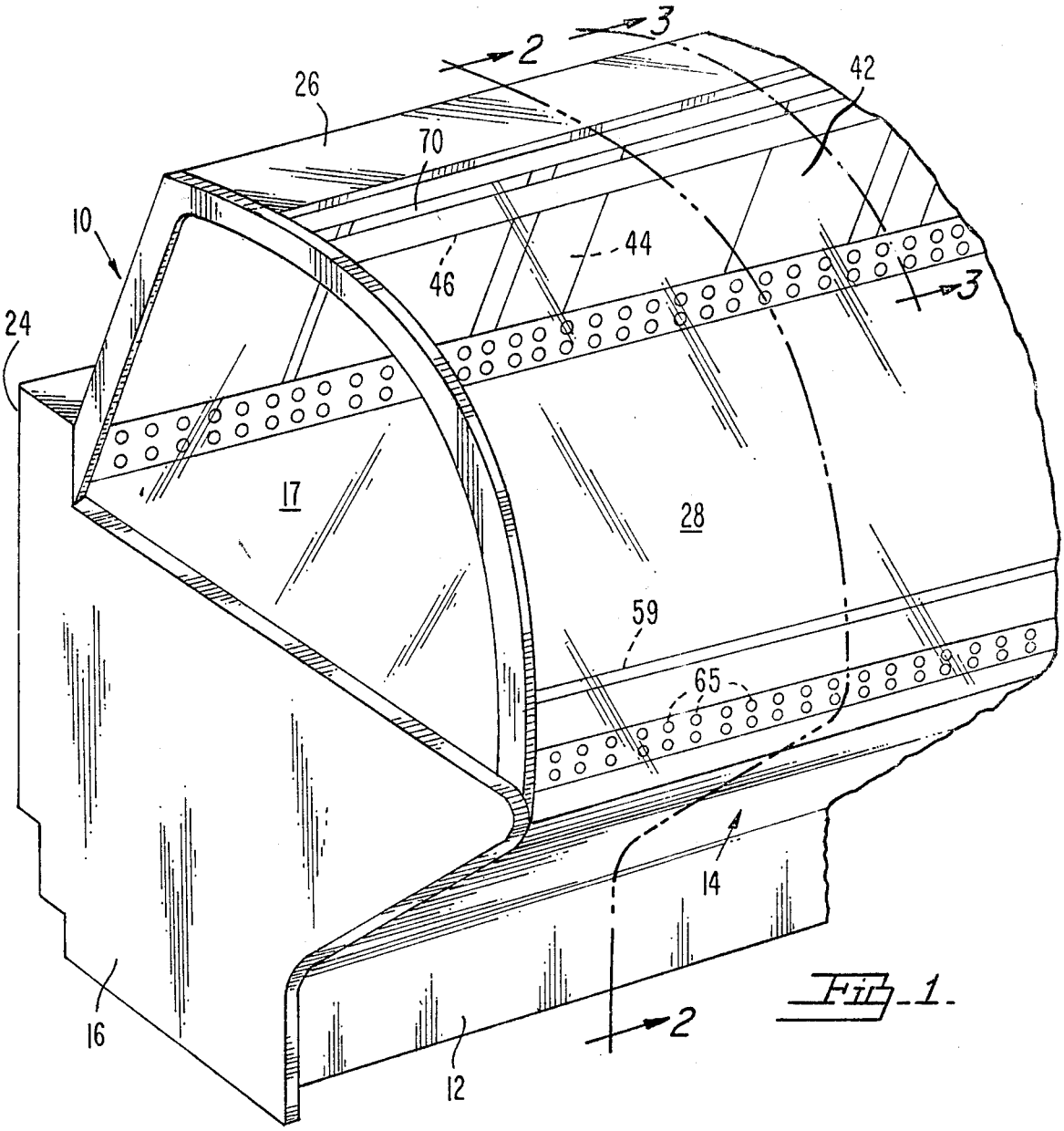
FIG. 1 is a fragmentary perspective view of a refrigerated food display case constructed in accordance with the present invention.

A refrigerated display case generally designated 10 includes the usual base 12 providing a drain gutter. Fixedly mounted upon the base is a food display well 14 of elongated, upwardly opening, trough-shaped configuration, suitably insulated to minimize heat transfer through the walls of the case. At each end of the case, there is provided an end closure panel 16, which may if desired be provided with an end display window 17.

Well 14 has, in its bottom wall 18, the usual drain opening 20, through which water produced by melting of ice and frost during defrost cycles is permitted to flow into the drain gutter.

Well 14 includes a front wall 22 and a rear wall 24. Also incorporated in the case is a flat top wall 26 which may also be suitably insulated against heat transfer, and fixedly mounted to extend the length of the case, between the top wall 26 and front wall 22, is a display window 28 hingedly connected at 29 to top wall 26.

As will be noted, window 28 has a first, lower portion **28*a* which is releasably, laterally engaged along its bottom edge with the upper edge of the front wall 22 and is inclined slightly from the vertical; a second or intermediate portion 28*b* which is inclined from the vertical to a distinctly greater extent than is the first portion; and a third or top portion 28*c* which is disposed substantially in a horizontal plane common to that of the horizontal top wall 26, so as to cooperate with the top wall 26 in forming the top of the display case. The several portions of the window are integrally joined by gradually curved connecting portions 28*d*, 28*e*. The several portions 28*a* through 28*e* cooperate in providing a smooth, uninterrupted interior surface devoid of connecting moldings or other obstructions that tend to cause turbulence in the air circulated within the case, and that further detract from the aesthetic appearance of the case as a whole, as well as detracting from the full visibility of the displayed food products. The means for releasably latching the window to wall 22** is well known in the art and since it is not critical to the invention, is not shown.

The window can of course be permanently, fixedly secured to the top and front walls, if desired. The invention is operable whether the window is of the hinged type, or alternatively is fixedly mounted.

Within the display case, there is provided a food display support pan 30, spaced upwardly from the bottom wall 18 of the well 14, to define therebetween a plenum 32. Pan 30 has a horizontal, flat bottom wall 33 integral with vertical front and rear walls 34, 36 respectively.

It will be understood at this point that suitable shelving can be provided within the food display compartment 37 of the display case, and since such shelving does not represent any part of the present invention, illustration thereof has been omitted.

At the entrance end of the plenum, there is provided the usual refrigerating coil 38, and within the plenum, downstream from the coil in the sense of the direction of air circulated within the case, there is provided the usual circulating fan 40.

Figure 3:
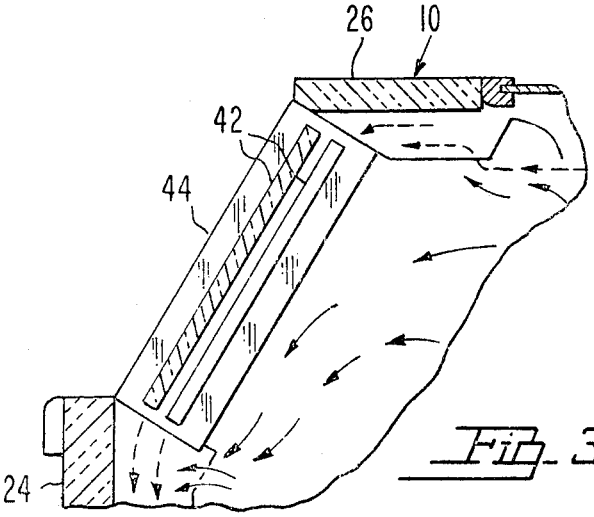
FIG. 3 is a fragmentary, transverse sectional view through the display case, substantially on line 3—3 of FIG. 1.

Referring to FIGS. 1 and 3, the display case is provided, at the rear thereof, with sliding glass access doors 42 interposed between hollow mullions 44.

Above the compartment 37, and located below the top wall 26, there is provided a return air passage top wall 46 formed with upper primary return air inlet openings 48. Defined between walls 46, 26 is an upper return air inlet passage 50, from which circulated air exits through return air inlet apertures 52 formed in the upper ends of the mullions 44.

At the lower ends of the mullions, there are provided outlet apertures 54, through which air flows along rear wall 24 into the inlet side of the coil 38, for rechilling and for recirculation by the fan 40.

Figure 2:
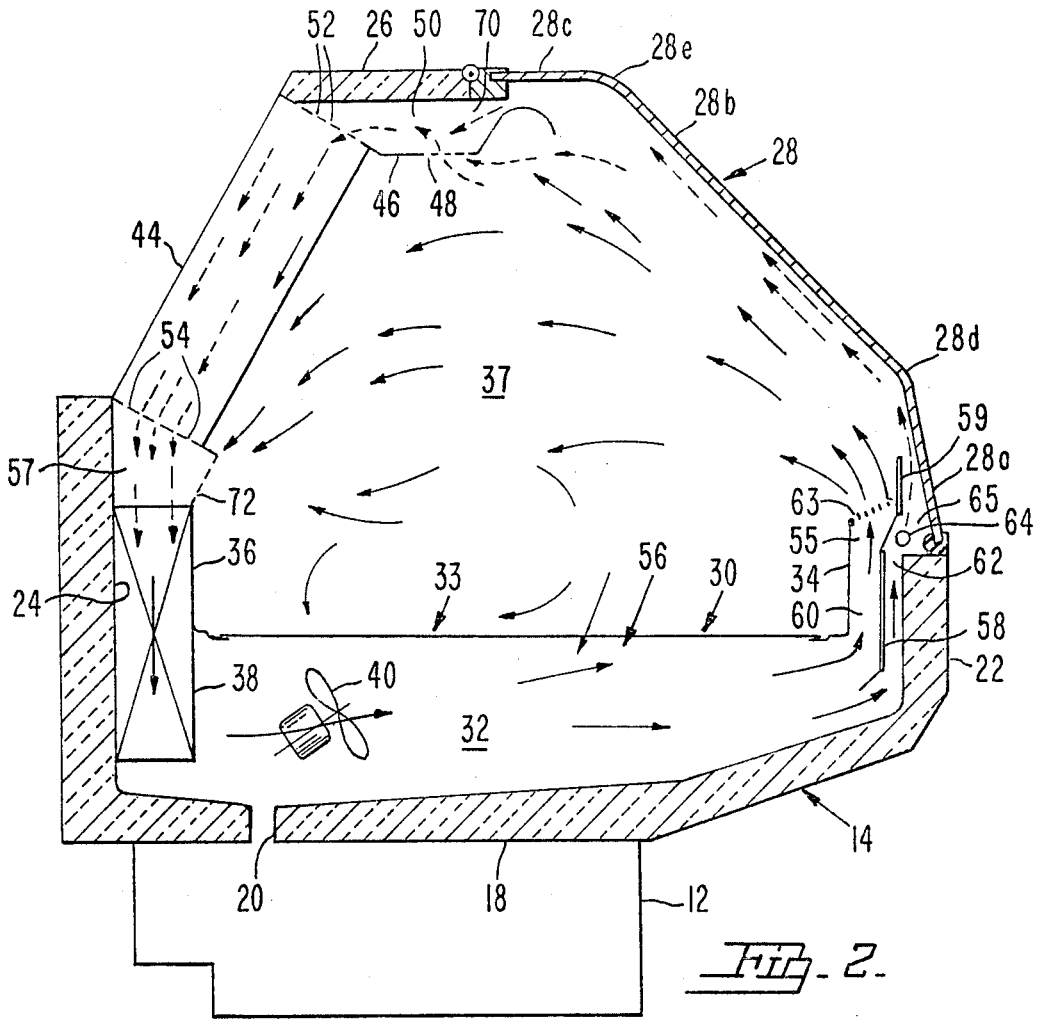
FIG. 2 is a transverse sectional view therethrough, substantially on line 2—2 of FIG. 1.

Air circulated within the case travels in the direction of the arrows shown in FIG. 2. Traveling in a closed path, it passes through an air duct generally designated 56, said duct having an inlet end at the inlet to the top air passage 50, from which the duct extends in a counter-clockwise direction (viewing the same as in FIG. 2) downwardly through the mullions 44, said duct further comprising a rear passage 57 in which coil 38 is mounted, plenum 32, and a front air passage 55 defined between walls 22, 34. Within the front passage 55 there is mounted a vertical divider or separator panel 58 formed of heat insulation material, having a forwardly offset extension 59 of transparent plastic or the like, extending parallel to and spaced rearwardly from the lower portion **28*a* of window 28**.

Figure 5:
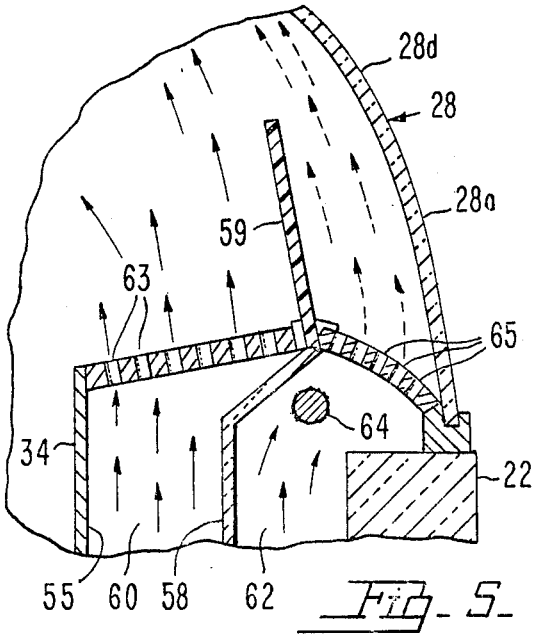
FIG. 5 is an enlarged, transverse, fragmentary sectional view on the same cutting plane as FIG. 2, showing the detailed construction of the case at the location of the outlets of the primary and secondary air curtains.
Figure 6:
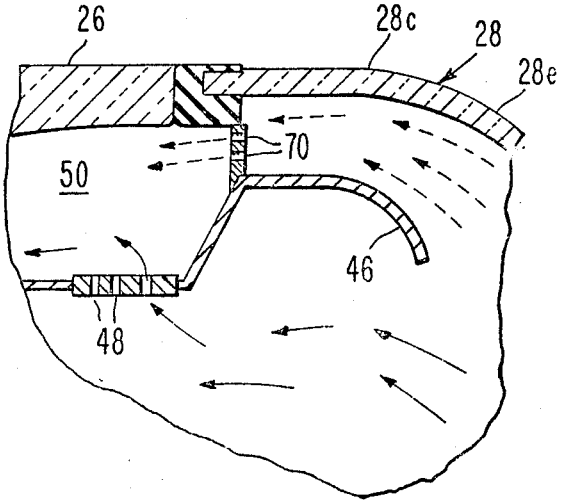
FIG. 6 is a similarly enlarged, fragmentary, transverse sectional view on the same cutting plane as FIG. 2, showing the detail of the construction at the location of the return air inlets provided at the top of the case.

Separator panel 58 defines, within passage 55, primary and secondary air passages 60, 62 respectively having outlet openings 63, 65 respectively (FIG. 5).

Figure 4:
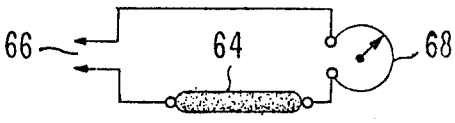
FIG. 4 is a schematic illustration of the electric circuitry utilized for energizing the heating element.

In accordance with the invention, there is mounted (see FIGS. 2 and 5), within the secondary passage 62, an elongated electrical heating element 64. This, in a commercial embodiment, would extend the length of the display window, and as shown in FIG. 4, would be connected to a suitable source of electric power 66, in circuit with a rheostat 68.

The element 64 is designed to be continuously energized, since during a defrost cycle, there is a tendency toward the formation of "sweat" or fog on the window. According to the prevailing ambient and case temperatures, the rheostat is usable to selectively adjust the extent to which the heating element is energized.

What is mainly important however, is that the heating element be energized at least during refrigerating cycles, either for the full length of the cycle or for as long a time during a refrigerating cycle as it is found desirable, for the purpose of increasing the temperature of air in the secondary air passage, prior to flow of that air out of the duct 56 and upwardly within the display compartment. The use of insulating material for panel 58 minimizes heat exchange between the warm air secondary passage and the chilled air primary passage.

Air flowing through the openings 63, 65 passes upwardly, as shown in FIG. 2, within the display compartment, in the form of primary and secondary air panels. Air in the primary air curtain or panel is designated by full line arrows, while the air of the secondary air curtain is denoted by broken-line arrows. It is important to note that initially, all air that has been circulated within the case is required to flow back to the inlet side of coil 38, to be re-chilled to a suitable temperature, according to the nature of the food products that are being displayed. The refrigeration load will vary according to the ambient temperature and humidity level within the store, air currents, and other factors that usually dictate the requirement of a field test for arriving at a final determination. Whatever that determination may be, the air refrigerated to a selected low temperature by coil 38 is circulated by fan 40 through the plenum 32, and enters the primary and secondary passages 60, 62.

It is thus seen that air entering the passages 60, 62 is at the same low temperature in both passages, until the air arrives at and passes the heating element 64. Element 64, being energized during a refrigerating cycle, elevates the temperature of the chilled air flowing through the secondary passage 62, before the air exits through openings 65 to flow along the inner surface of the display window. However, the chilled air flowing through the primary passag 60 remains in its fully chilled or refrigerated condition, and when it exits through openings 63, flows upwardly as a primary, refrigerated air curtain that flows upwardly above and in some instances passes through the displayed food products prior to return to the coil for re-chilling.

The secondary air curtain, as seen from FIG. 2, is interposed between the display window and the primary curtain. Through the provision of the offset extension 59 of the separator panel 58, it is immediately directed against the inner surface of the lower portion **28*a*, and flows directly along the inner surfaces of window portions 28*d*, 28*b*, 28*e*, and 28*c*, before re-entering the air duct through inlet openings 70**.

The provision of the smoothly curved, uninterrupted connecting portions **28*d*, 28*e***, as will be seen, eliminates any turbulent effect as regards either the secondary or the primary panel. The panels flow upwardly along their assigned paths, without interruption by moldings, sharp angles, or the like. In this way, the entire surface of the window, within the case, is in contact with the secondary air curtain, and as a result, the formation of condensate is completely eliminated or in an event reduced to an acceptable level.

As will be seen from FIG. 2, the air inlet openings 70 are disposed directly in the path of the air flowing as part of the secondary panel. Any air in said panel that tends to fall as it nears the top of the case is, however, drawn upwardly through the inlet openings 48. Further, some of the air of the primary panel is drawn upwardly through the openings 48, so that both primary and secondary air is intermixed within the upper passage 50, prior to traveling downwardly within the mullions 44 back to the coil 38.

There are also provided return openings 72, between the discharge ends of the mullions 44 and the inlet side of coil 36. These openings 72 are formed in the rear air passage 57, and the air of the primary air curtain that drops downwardly for flow directly across the food product enters through said openings 72.

The openings 48, 70 may be appropriately termed a first set of return air inlet openings, while the openings 72 can be considered as a second set of said return air inlet openings.

The display case can be equipped as desired. It is primarily intended as a deli or fish case, but can also be used for merchandising service meats or fresh meats. Such uses may dictate the provision of special shelving or the like, none of which is believed essential to illustrate for the purpose of understanding the operation of the invention.

The advantages of the display case are that essentially, it requires little modification from an ordinary case of this type having no anti-condensation features of any kind. In accordance with the invention, it is necessary only to provide the electrical heating element and the separator panel, along with the provision of the openings 48, 70, with the openings 70 being located very close to the upper edge of the display window. Most importantly, the invention permits the provision of a single-pane, essentially curvilinear window, characterized by a complete absence of interior moldings or divider strips such as would tend to cause air turbulence within the case. Though an aesthetically pleasing display window is utilized as illustrated and described, permitting viewing of the product from directly above as well as from the front of the case, without interruption by connecting moldings, the highly desirable result of preventing or minimizing condensation is nevertheless achieved.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. In a closed front, refrigerated food display case of the type that comprises a display compartment having a front display window, said case further having one duct for refrigerated air, said duct having inlet and outlet openings adjacent opposite edges of said window, a refrigerating coil mounted within said duct for chilling the air passing therethrough to a selected low temperature, and a fan for circulating the refrigerated air within the duct in a path extending from the outlet openings and across the display window to the inlet openings for re-chilling within the duct and recirculation within the display compartment, said case having refrigerating cycles during which both the coil and fan operate simultaneously to chill and circulate said air, the improvement comprising:

(a) a divider panel mounted within the air duct adjacent the outlet openings and window, said panel separating the duct into a primary inner passage and a secondary outer passage into which all the air chilled to said low temperature is channeled, the length of the passages being limited to the portion of the duct immediately adjacent said outlet openings, said passages dividing the air flowing from the duct through the outlet openings into primary and secondary air curtains; and (b) heating means mounted in the path of the refrigerated air flowing through the secondary passage only, said heating means being actuated during the refrigerating cycles of the display case at times when the coil and fan are in simultaneous operation, to heat the refrigerated air that flows through the secondary passage and thereby form the same into a warm air, anti-condensation secondary curtain interposed between the window and the refrigerated primary air curtain.

2. In a closed front, refrigerated food display case of the type that comprises a display compartment having a front display window, said case further having a primary refrigerated air duct having inlet and outlet openings, a refrigerating coil, and a fan for circulating refrigerated air within the duct in a path extending from the outlet openings and across the display window to the inlet openings for re-chilling within the duct and recirculation within the display compartment, the improvement comprising:

(a) a divider panel mounted within the air duct adjacent the outlet openings and window, said panel separating the duct into a primary inner passage and a secondary outer passage so as to divide air flowing from the duct into primary and secondary air curtains; and (b) heating means mounted in the path of refrigerated air flowing through the secondary passage only, said heating means being operable, at least at times when the air flowing through the duct is being chilled by the coil and circulated by the fan, to heat the refrigerated air that flows through the secondary passage and thereby form the same into a warm air, anti-condensation curtain interposed between the window and the refrigerated primary air curtain, the case further comprising rear access doors and mullions separating the doors, said mullions having air conduits through which air circulated by the fan flows back to the coil for re-chilling thereof after separation of the air into said primary and secondary curtains.

3. In a display case, the improvement of claim 2 wherein the inlet openings comprise first and second sets of return air inlet openings located respectively upstream and downstream from the mullions in the sense of the direction in which air is circulated within the case by said fan, said first and second sets of inlet openings being respectively arranged to receive the air of the secondary and primary curtains respectively for re-chilling thereof within the duct and recirculation through the display compartment.

4. In a display case, the improvement of claim 3 wherein all of said inlet openings are upstream from said coil.

5. In a display case, the improvement of claim 4 wherein at least some of the air of the primary curtain enters both the first and second sets of return air inlet openings.

6. In a display case, the improvement of claim 5 wherein the first set of inlet openings is located to require that all of the air of the secondary curtain enter the same.

7. In a display case, the improvement of claim 6 in which at least one of the openings of the first set is disposed in close proximity to the window surface and opens within the path of air flowing in the secondary air curtain.

8. In a display case, the improvement of claim 7 wherein said first set of openings includes at least one other opening facing downwardly into the display compartment in position to receive at least a portion of the air of the primary curtain.

* * * * *